US005481156A

United States Patent [19]

Lee et al.

[11] Patent Number: 5,481,156

[45] Date of Patent: Jan. 2, 1996

[54] FIELD EMISSION CATHODE AND METHOD FOR MANUFACTURING A FIELD EMISSION CATHODE

[75] Inventors: Jong-deuk Lee, Seoul; Hyeong-su Woo, Bucheon; Sun-jeong Choi; Gang-ok Lee, both of Suwon, all of Rep. of Korea

[73] Assignee: Samsung Display Devices Co., Ltd., Kyungki-do, Rep. of Korea

[21] Appl. No.: 302,517

[22] Filed: Sep. 8, 1994

[30] Foreign Application Priority Data

Sep. 16, 1993 [KR] Rep. of Korea ..... 93-18662

[51] Int. Cl.[6] ..... H01J 9/02

[52] U.S. Cl. ..... 313/309; 313/351; 445/50

[58] Field of Search ..... 445/50; 313/309, 313/310, 336, 351

[56] References Cited

U.S. PATENT DOCUMENTS

| | | | |
|---|---|---|---|
| 3,970,887 | 7/1976 | Smith et al. | 313/309 |
| 4,084,942 | 4/1978 | Villalobos | 313/336 X |
| 4,513,308 | 4/1985 | Greene et al. | 357/55 |
| 5,401,676 | 3/1995 | Lee | 445/50 X |

*Primary Examiner*—Kenneth J. Ramsey
*Attorney, Agent, or Firm*—Foley & Lardner

[57] ABSTRACT

A field emission cathode and a method of manufacturing a field emission cathode, wherein a primitive tip is formed under a first thermal oxide layer, and a nitride layer is formed on the surface of the first thermal oxide layer covering the primitive tip so that only the lower portion of the tip is oxidized without the upper portion of the tip being oxidized by a second thermal oxidation process. The method can attain a constant and controllable tip height.

7 Claims, 4 Drawing Sheets

FIELD EMISSION CATHODE AND METHOD FOR MANUFACTURING A FIELD EMISSION CATHODE

BACKGROUND OF THE INVENTION

1. Field of Invention

The present invention relates to a method for manufacturing a field emission cathode and more particularly is directed to a method for manufacturing a field emission cathode microtip. The present invention is also directed to a field emission cathode having a large electron-emitting area which enables high electron emission and minimizes cathode tip erosion.

2. Description of Related Art

With the increasing demand for the popular use and miniaturization of displays which serve as the interface between human beings and computers or other computerized mechanisms, various flat screens or flat-panel displays have been developed for use instead of cathode ray tubes which are relatively large and difficult to handle. Such flat-panel displays include plasma display panels, liquid crystal panels, fluorescent display panels, field emission display panels, and the like. Among the flat-panel displays, the field emission display panel can be driven with low power consumption and may be easily used to produce color images.

The field emission display panel is constructed to emit electrons using a field emission array in which cathode tips are densely integrated as a field emission source for every unit pixel and also to converge the emitted electrons onto the phosphorous screen, and thereby form a picture or image.

The cathode tip is usually made of metal and is placed in a high-vacuum closed space which facilitates electron emission. Recently, according to the development of semiconductor device manufacturing technology, various manufacturing methods of microtips have been proposed using the same.

For instance, U.S. Pat. No. 4,513,308 to Greene et al. discloses a field emission cathode in which a pyramidal field emission cathode structure is placed on a monocrystal substrate using a P-N junction.

U.S. Pat. No. 3,970,887 to Smith et al. discloses a field emission cathode and a manufacturing method thereof in which a field emission tip is formed on the semiconductor substrate by thermal oxidation. According to this method of Smith et al., an oxide pattern mask is first formed on a silicon substrate by electron beam evaporation. The substrate is then thermally oxidized twice so that the masked portion and the unmasked portion receive different levels of thermal oxidization. The difference of thermal oxidation speeds forms an intended field emission tip.

In the method according to Smith et al., however, since the tip forming reaction is subject to and dependent on the concentration of a reaction gas, it is difficult to control the height of the field emission cathode tip as well as the sharpness of the tip. Further, this method has disadvantages during mass production because the forming of the pattern mask depends on and is limited by evaporation and photolithography.

SUMMARY OF THE INVENTION

Therefore, it is an object of the present invention to provide an improved field emission cathode in which a silicon tip for emitting electrons has a physically and thermally stable structure. It is a further object of the present invention to provide a method for manufacturing a field emission cathode wherein the time to form an insulating layer is reduced.

To accomplish the object of the present invention, there is provided a method of manufacturing a field emission cathode comprising the steps of: doping an N-type impurity on a substrate and thermally oxidizing the doped surface of the substrate so as to form a first thermal oxide layer having a predetermined thickness; partially etching the first thermal oxide layer of the substrate so as to form a predetermined pattern of mask; etching the surface of the substrate perpendicular thereto so as to form a protrusion of a predetermined height on a portion in which the mask pattern is not formed; thermally oxidizing the substrate so as to form a second thermal oxide layer on the surface of the substrate; forming a nitride layer having a predetermined thickness on the overall surface of the oxide layer; removing the nitride layer excluding the portion of the nitride layer formed on the periphery of the protrusion; thermally oxidizing the substrate so as to form a third thermal oxide layer above and below the second thermal oxide layer located on the portion excluding the protrusion; etching and removing said nitride layer covering the protrusion; depositing a metal on the surface of the second thermal oxide layer excluding the surface portion covering the protrusion so as to form a gate electrode; and etching the substrate in which the gate electrode is formed, and partially removing the second and third thermal oxide layers so as to expose the protrusion between the gate electrode.

In the manufacturing method of the present invention, it is desirable that the second thermal oxide layer be 2,000–4,000 Å thick and that the nitride layer be substantially 1,000 Å thick.

There is also provided a novel field emission cathode having a tip portion extending upward from a top surface of a substrate, wherein a vertical cross-section of the tip portion comprises a triangular shaped upper portion and a bell-shaped lower portion whose surface extends downwardly with gradually decreasing slope from the upper portion to the top surface of the substrate. The surface of the lower portion of the tip portion may extend downwardly from the triangular upper portion with sharply increasing slope until a full vertical slope is achieved before extending downwardly with gradually decreasing slope to the top surface of the substrate.

DETAILED DESCRIPTION OF THE PREFERRED EMBODIMENTS

Figure 10A:
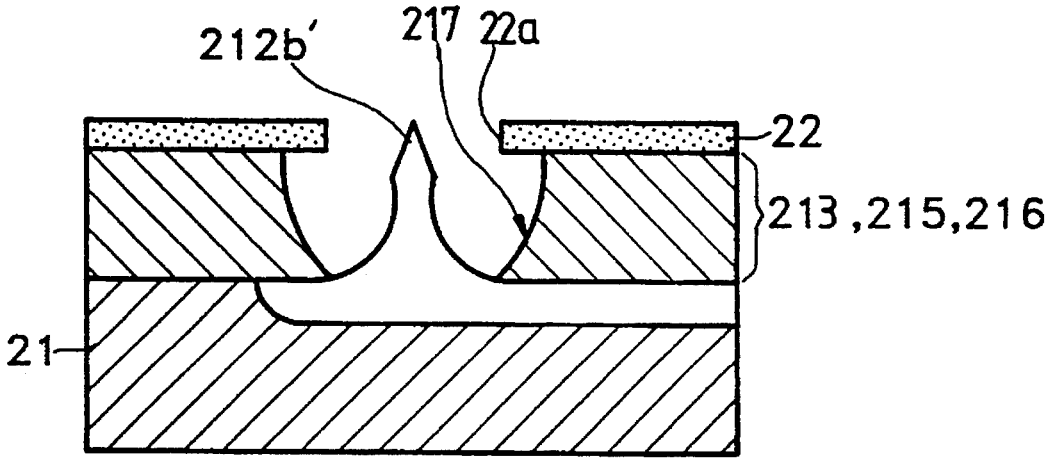
FIGS. 10A and 10B are extracted cross-sectional views of a field emission cathode fabricated according to the manufacturing method of the present invention.
Figure 10B:
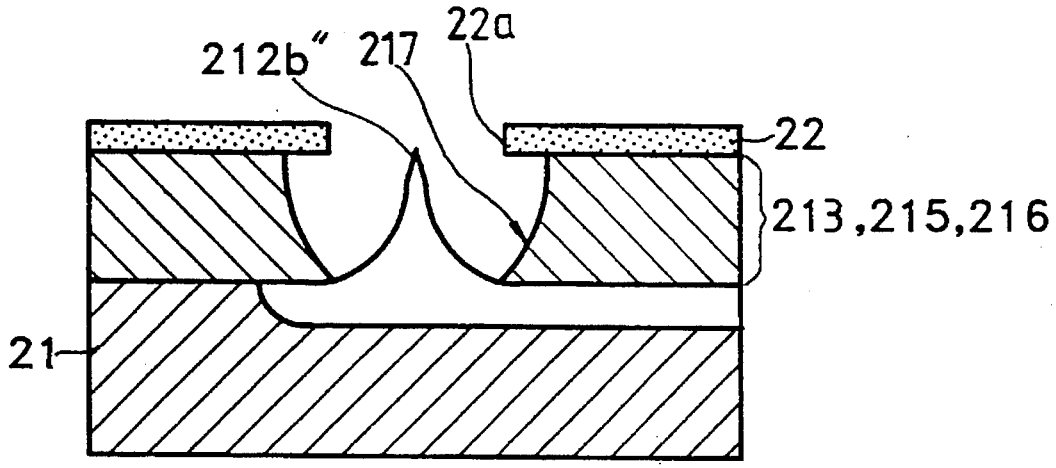

Referring to FIGS. 10A and 10B, a multilayer insulator (213, 215 and 216) having a pin hole 217 is formed on the surface of a silicon substrate 21. A gate electrode 22 having a through hole 22*a* is formed on a portion corresponding to pin hole 217 on multilayer insulator (213, 215 and 216). A silicon tip 212*b'* or 212*b"* is provided inside pin hole 217.

The silicon substrate 21 is spaced apart by a predetermined distance from a front substrate (not shown) on which an anode layer and phosphorous layer are formed.

FIGS. 10A and 10B show tips 212*b'* and 212*b"* of different shapes which are the result of the manufacturing method of the present invention set forth below.

A method for manufacturing the field emission cathode of the present invention will be described below with reference to FIGS. 1–9 by individual steps.

Figure 1:
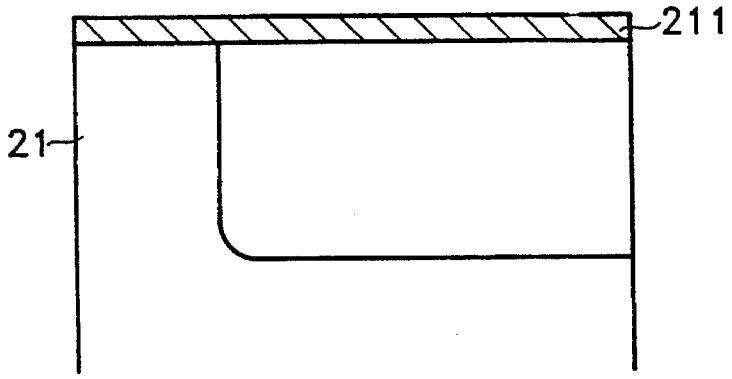
FIGS. 1–9 are cross-sectional views illustrating the sequential processing steps of a substrate according to the manufacturing method of the present invention.
Figure 2:
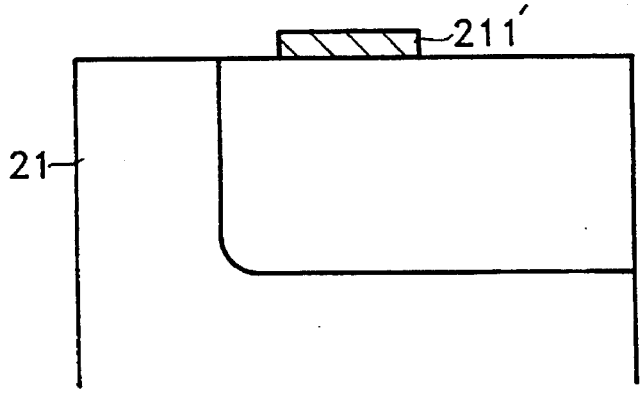
Figure 3:
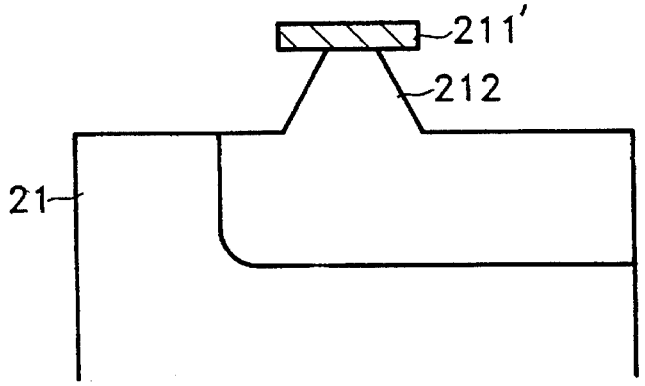
Figure 4:
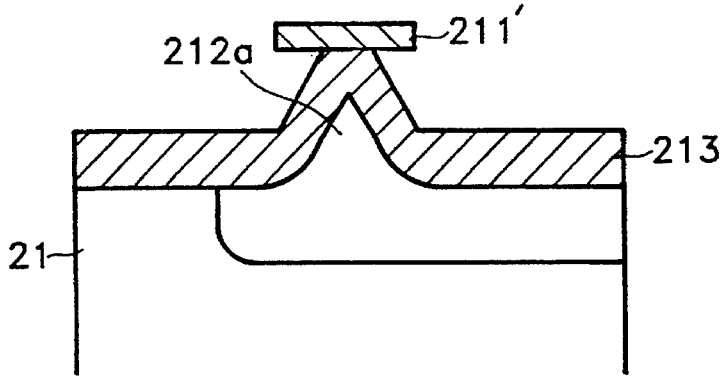
Figure 5:
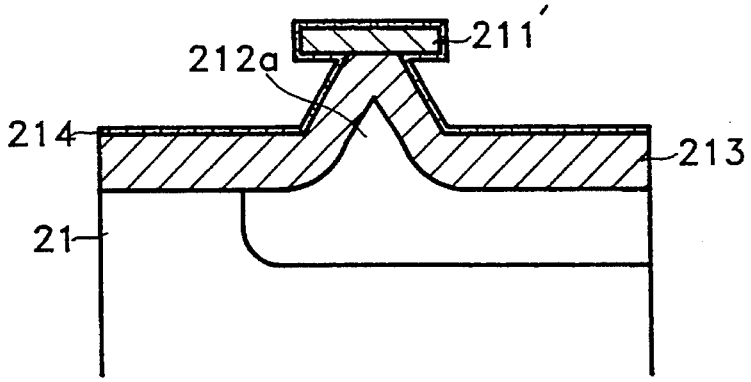
Figure 6:
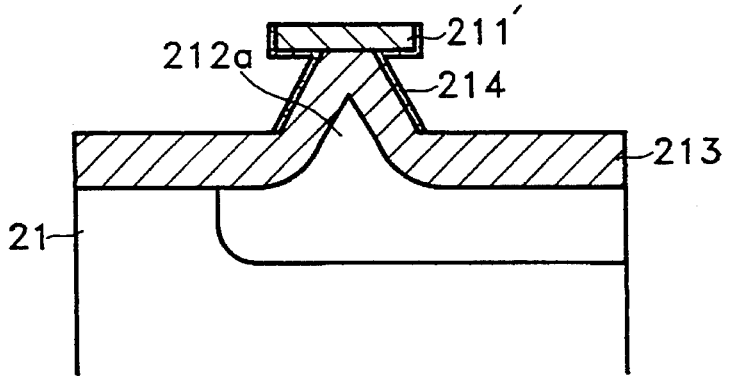
Figure 7:
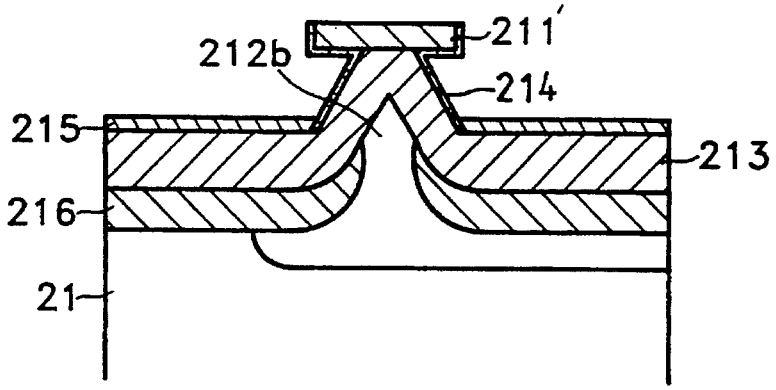
Figure 8:
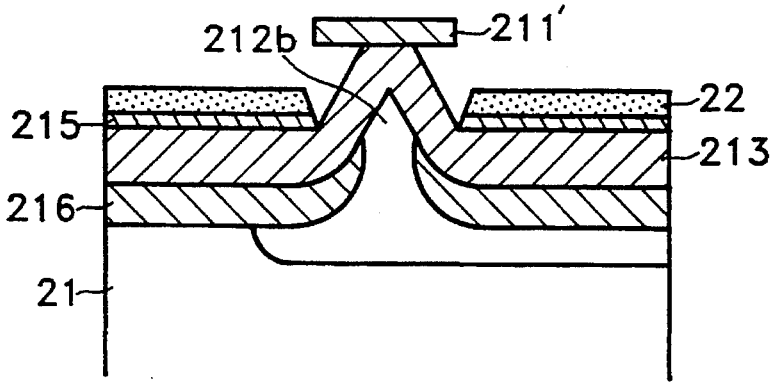
Figure 9:
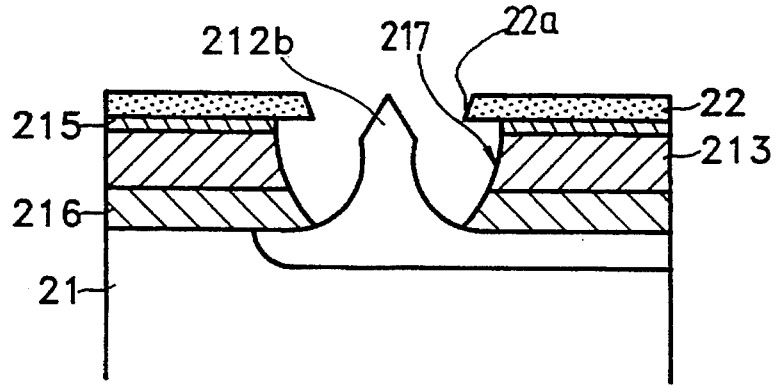

1. As shown in FIG. 1, N-type impurity, for instance, Sb and As, is doped in a predetermined pattern, into the upper portion of a silicon substrate 21 the surface of which is then thermally oxidized to form a first thermal oxide layer 211 having a thickness greater than about 4,000 Å.
2. As shown in FIG. 2, the first thermal oxide layer of substrate 21 is treated by photolithography to form a predetermined mask pattern 211' which is provided corresponding to a portion where a silicon tip is formed.
3. As shown in FIG. 3, substrate 21 is anisotropically etched perpendicular to the surface so that the portion where the mask pattern is not formed is etched to a predetermined depth to form a tip 212 which is located under mask 211' formed on substrate 21. In this step, a reactive ion etching is desirably used.
4. As shown in FIG. 4, in order to sharpen the silicon tip, silicon substrate 21 is thermally oxidized a second time to form an oxide layer 213 ($SiO_2$) over a diminished tip 212*a*.
5. As shown in FIG. 5, a nitride layer ($Si_3N_4$) 214 of 1,000 Å is formed on the overall surface of oxide layer 213. In this step, low-pressure chemical vapor deposition is desirably used.
6. As shown in FIG. 6, the nitride layer is removed excluding the nitride layer 214 formed around tip 212*a*.
7. As shown in FIG. 7, the substrate 21 is thermally oxidized a third time to form third oxide layers 215 and 216 above and below the second oxide layer while excluding the portion of the tip. During the third oxide layer formation, since diminished tip 212*b* is protected by nitride layer 214, the upper portion of tip 212*b* is not oxidized and only the lower portion thereof is oxidized to a predetermined depth.
8. As shown in FIG. 8, the nitride layer covering tip 212*b* is etched by a solution such as phosphoric acid, to be removed. Cr, Mo and W are evaporated on the surface of second oxide layer 213 excluding the surface thereof covering the tip, to form a gate electrode 22.
9. As shown in FIG. 9, after the formation of gate electrode 22, the substrate 21 is etched by a solvent (BHF). The second and third oxide layers covering tip 212*b* are selectively removed so that the tip is exposed between the gate electrode.

In the above-described manufacturing method of the present invention, an intended tip is accomplished in such a way that a primitive tip located under the second thermal oxide layer is formed through a second thermal oxidation step, and a nitride layer is then formed on the surface of the second thermal oxide layer covering the primitive tip so that, during the third thermal oxidation step, the upper portion of the tip protected by the nitride layer is not affected but the lower portion of the tip is partially oxidized.

In the manufacturing method of the present invention, after the photolithography for mask patterning is performed and the silicon substrate is etched to define the height and profile of the tip, a first thermal oxidation is performed. By doing so, the height of the tip and the thickness of the thermal oxide layer can be freely controlled. Especially, the upper portion of the tip can be formed as intended.

After the second thermal oxidation, since the nitride layer obtained through the chemical evaporation is removed (excluding the portion thereof covering the tip by a dry etching), the tip is not affected during the third thermal oxidation so that the tip does not become worn or reduced in height.

Further, in the manufacturing method of the present invention, during the third thermal oxidation, the diffusion density can be controlled so that, while a predetermined sharpness and height of the tip is maintained, a selection of tip shapes is attainable as suggested in FIGS. 10A and 10B.

Accordingly, the present invention facilitates accomplishing the field emission arrays shown in FIGS. 10A and 10B, and as mentioned above, the height of the tip can be freely controlled. Especially, since two thermal oxide layers (second and third) are provided as insulating layers under the gate electrode, the present invention enables the manufacture of products having a considerably high breakdown value of the electric field and reduces the production of deficient products.

The difference between the results of the conventional manufacturing method and the manufacturing method of the present invention is as follows.

First, while the electric field breakdown value of an insulating layer by electron beam evaporation is 2 MV/cm, the insulating layers according to the manufacturing method of the present invention have an electric field breakdown value which measures 8 MV/cm collectively.

Different from the conventional tip shape which is conic, the tip of the present invention maintains thermal and physical stability without adopting the simple conic shape.

As shown in FIGS. 10A & 10B, a field emission cathode according to the instant invention is characterized in that it has a tip portion that extends upward from the top surface of the substrate and has a vertical cross-section that comprises a triangular shaped upper or top portion and a bell-shaped lower or bottom portion that extends downwardly with gradually decreasing slope to the top surface of the substrate. The surface of the lower or bottom portion may also extend downwardly from the triangular-shaped upper or top portion with increasing slope until a full vertical slope is achieved before extending downwardly with gradually decreasing slope to the top surface of the substrate.

In addition, since the insulating layers of the present invention are obtained through thermal oxidation, the productivity of the insulating layers is much higher than those obtained by electron beam evaporation. For instance, while the conventional method deals with one sheet of substrate at a time in forming the insulating layers, the manufacturing method of the present invention can treat tens of sheets at once because thermal oxidation is utilized.

What is claimed is:

1. A method of manufacturing a field emission cathode comprising the steps of:

doping an N-type impurity on a substrate;

thermally oxidizing a surface of said substrate so as to form a first thermal oxide layer having a predetermined thickness;

partially etching said first thermal oxide layer of said substrate so as to form a predetermined mask pattern;

etching said substrate perpendicular to the surface on a portion in which said mask pattern is not formed so as to form a protrusion of a predetermined height;

thermally oxidizing said substrate so as to form a second thermal oxide layer on the surface of said substrate;

forming a nitride layer having a predetermined thickness on the overall surface of said first and second oxide layers;

removing said nitride layer excluding a portion of said nitride layer formed on a periphery of said protrusion;

thermally oxidizing said substrate so as to form a third thermal oxide layer above and below said second thermal oxide layer, said third thermal oxide layer excluding an upper portion of said protrusion;

etching and removing a remaining portion of said nitride layer covering said protrusion;

depositing a metal on the surface of said second thermal oxide layer excluding a portion covering said protrusion so as to form a gate electrode; and etching said substrate in which said gate electrode is formed, and partially removing said second and third thermal oxide layers so as to expose said protrusion between portions of said gate electrode.

2. A method of manufacturing a field emission cathode as claimed in claim 1, wherein said second thermal oxide layer is 2,000–4,000 Å thick.

3. A method of manufacturing a field emission cathode as claimed in claim 2, wherein said nitride layer is substantially 1,000 Å thick.

4. A method of manufacturing a field emission cathode as claimed in claim 1, wherein said nitride layer is substantially 1,000 Å thick.

5. A field emission cathode manufactured according to the method of claim 1.

6. A field emission cathode manufactured according to the method comprising the steps of:

doping an impurity on a principal surface of a substrate;

thermally oxidizing said principal surface of said substrate so as to form a first thermal oxide layer having a predetermined thickness;

partially etching said first thermal oxide layer to form a predetermined pattern of an oxide mask;

etching said substrate perpendicular to said principal surface of said substrate to form a protrusion of a predetermined height beneath said oxide mask;

thermally oxidizing said substrate so as to form a second thermal oxide layer on the principal surface of said substrate;

forming a nitride layer having a predetermined thickness to completely cover an exposed surface of said first and second oxide layers;

selectively removing said nitride layer leaving a portion of said nitride layer formed around a periphery of said protrusion;

thermally oxidizing said substrate to form a third thermal oxide layer above and below said second thermal oxide layer, wherein formation of said third thermal oxidation layer excludes a tip portion of said protrusion;

removing a remaining portion of said nitride layer;

depositing metal on a top surface of said third thermal oxide layer to form a gate electrode; and partially removing said second and third thermal oxide layers so as to expose said protrusion.

7. A field emission cathode, comprising:

a substrate;

a gate electrode disposed on said substrate and having a gap therein;

a protrusion on a top surface of said substrate located between said gap of said gate electrode, a cross-section of said protrusion having a triangular shaped top portion and a bell-shaped lower portion gradually extending downward from said top portion to said top surface of said substrate.

* * * * *